United States Patent [19]

Ina et al.

[11] Patent Number: 4,800,499

[45] Date of Patent: Jan. 24, 1989

[54] APPARATUS FOR PROCESSING ENGINE OPERATION DETECTION SIGNALS

[75] Inventors: Katsuhiro Ina, Okazaki; Susumu Akiyama, Kariya; Yuzi Hirabayashi, Aichi, all of Japan

[73] Assignee: Nippondenso Co., Ltd., Kariya, Japan

[21] Appl. No.: 854,818

[22] Filed: Apr. 23, 1986

[30] Foreign Application Priority Data

Apr. 24, 1985 [JP] Japan ..... 60-86239

[51] Int. Cl.[4] ..... F02P 9/00; F02D 41/30

[52] U.S. Cl. ..... 364/431.03; 364/431.05; 364/431.08; 123/480; 123/417; 123/428

[58] Field of Search ..... 123/480, 417, 418, 488, 123/474, 428, 492, 493, 426; 364/431.04, 431.05, 431.07, 431.08, 431.03, 717; 180/176

[56] References Cited

U.S. PATENT DOCUMENTS

| | | | |
|---|---|---|---|
| 3,790,768 | 2/1974 | Chevalier et al. | 364/717 |
| 4,161,041 | 7/1979 | Butler et al. | 364/717 |
| 4,262,526 | 4/1981 | Makita et al. | 73/116 |
| 4,347,571 | 8/1982 | Leung et al. | 364/431.08 |
| 4,509,488 | 4/1985 | Förster et al. | 123/481 |
| 4,635,214 | 1/1987 | Rasai et al. | 364/551 |
| 4,650,020 | 3/1987 | Mizuno et al. | 180/176 |
| 4,690,123 | 9/1987 | Kimura et al. | 123/414 |

FOREIGN PATENT DOCUMENTS 1257779 12/1971 United Kingdom .

*Primary Examiner*—Felix D. Gruber
*Assistant Examiner*—Ellis B. Ramirez
*Attorney, Agent, or Firm*—Cushman, Darby & Cushman

[57] ABSTRACT

A rotation signal Ne is generated for every 1° of rotation of the engine crankshaft together with a crankshaft angle signal G for every 360° of crankshaft rotation. In response to each rotation signal Ne, a pseudo random number generator generates random number data which is converted to analog data by a D/A converter and supplied to a comparator circuit. An intake air pressure detection data Pim is also supplied to the comparator circuit and the two signals are compared. When the detection data Pim is larger than the converted analog data, the comparator output level is high. The output from the comparator is read for every rotation signal Ne and, when the detection data is larger than the analog data from the D/A converter, a counter is incremented. The count value is read for every generation of the crankshaft signal G and is supplied to the engine control unit as the intake air pressure detection data. The counter is then reset to the initial count value.

12 Claims, 4 Drawing Sheets

APPARATUS FOR PROCESSING ENGINE OPERATION DETECTION SIGNALS

BACKGROUND OF THE INVENTION

This invention relates generally to an apparatus for processing the signals from a device which detects the operating state of an engine, and particularly to an apparatus which converts detection signals that pulsate in correspondence to the rotation of the engine to signals from which the pulsation has been removed to thereby accurately indicate the operating state of the engine based on the air intake volume or the intake pipe pressure for accurate electronic control of the engine.

For example, when the fuel injection amount and the ignition timing, etc., are electronically controlled by an engine control unit using a microcomputer, the operating state of the engine is detected and the control unit calculates a suitable amount of fuel to be injected and a suitable injection timing for the operating state of the engine based on these detection signals. Various sensors are used to detect the operating state of the engine such as an intake air sensor provided in the intake air pipe for supplying air to the engine and a pressure sensor for detecting the air pressure in the intake pipe.

The quantity and pressure of the air flowing in the intake pipe, however, varies in response to the cycle of the engine so the detection signal pulsates. Accordingly, these pulsating detection signals cannot be used as is and cannot be supplied directly to the control unit and used in calculating the engine control data.

It has, consequently, been considered desirable to eliminate the pulsating component in the detection signals using an averaging circuit or an active filter circuit, for example, converting these signals to suitable digital signals and supplying them to the control unit, which comprises a microcomputer, as input data. Another possibility that has been considered is synchronizing the signals with a specific crankshaft rotation angle, A/D converting the signals, extracting level data of the portion corresponding to the phase of the pulsating detection signal and using these extracted signals as the detection signals.

However, using such means to take out the measurement signals of the air volume, for example, results in a delay when there is an abrupt change in the operating state of the engine, such as during rapid acceleration. When the detection signals are synchronized with the crankshaft angle, there is an inevitable deviation between the crankshaft angle and the pulsating signal so that these signals lack accuracy.

SUMMARY OF THE INVENTION

An object of the invention is to provide an apparatus which can be used in an electronic engine control unit to process accurately obtained signals from a device for detecting the operating state of the engine based on these signals, which correspond to the combustion operation of the engine.

Another object of the invention is to provide an apparatus which processes the detection signals from a device for detecting the operating state of the engine based on the intake air and the intake air pressure and which eliminates the pulsating component corresponding to the combustion operation of the engine from these signals for accurate calculation of the amount of fuel to be injected and the ignition timing, etc.

Another object of the invention is to provide an apparatus for processing signals that accurately follow rapid changes in the operating state of the engine for effective use in an engine control unit that comprises a microcomputer, for example, to thereby control the amount of fuel to be injected and the ignition timing, etc.

The signal processing apparatus of the invention generates signals corresponding to a specified rotation angle or signals of a specified frequency and generates pseudo random number signals corresponding to these frequency signals. These pseudo random numbers are compared to the detection signals corresponding to the measurement values of the intake air volume of the engine, for example, and a counter is incremented when the value of the detection signal is larger than the corresponding random number. The count value of the counter is read in response to the signals generated at a specified crankshaft angle of the engine and having a period larger than the frequency signals, which generate the pseudo random numbers. The count value, which has been read, is used as the measurement detection signal of the intake air volume and is sent to the engine control unit as input data. The count value of the counter is reset at the time it is read and counting begins afresh.

When the output signal from a sensor that measures the input air pressure, for example, is processed by this kind of signal processing apparatus, a random number signal corresponding to the individual rotation numbers Ne generated at each crankshaft angle of 1° (CA) is generated. The generated random number is compared to the detection signal from the intake air pressure sensor, and when it is determined that the detection signal is larger than the generated random number, the counter is incremented by 1. Accordingly, this counter stores the average value of the intake air pressure detection signal, and this count value is read at the crankshaft angle G of each rotation of the engine. This read out signal is supplied to the engine control unit and is used to calculate the amount of fuel to be injected and the ignition timing, etc. In other words, even though the measurement value of the intake air pulsates in response to the engine combustion operation, it is possible to obtain a measurement detection signal that corresponds to an accurate value of the intake air pressure. This makes it possible to accurately control the fuel injection quantity and the ignition timing, etc., and even if there is an abrupt change in engine operation conditions, detection signal processing with satisfactory response can be performed.

DETAILED DESCRIPTION OF THE PREFERRED EMBODIMENTS

Figure 1:
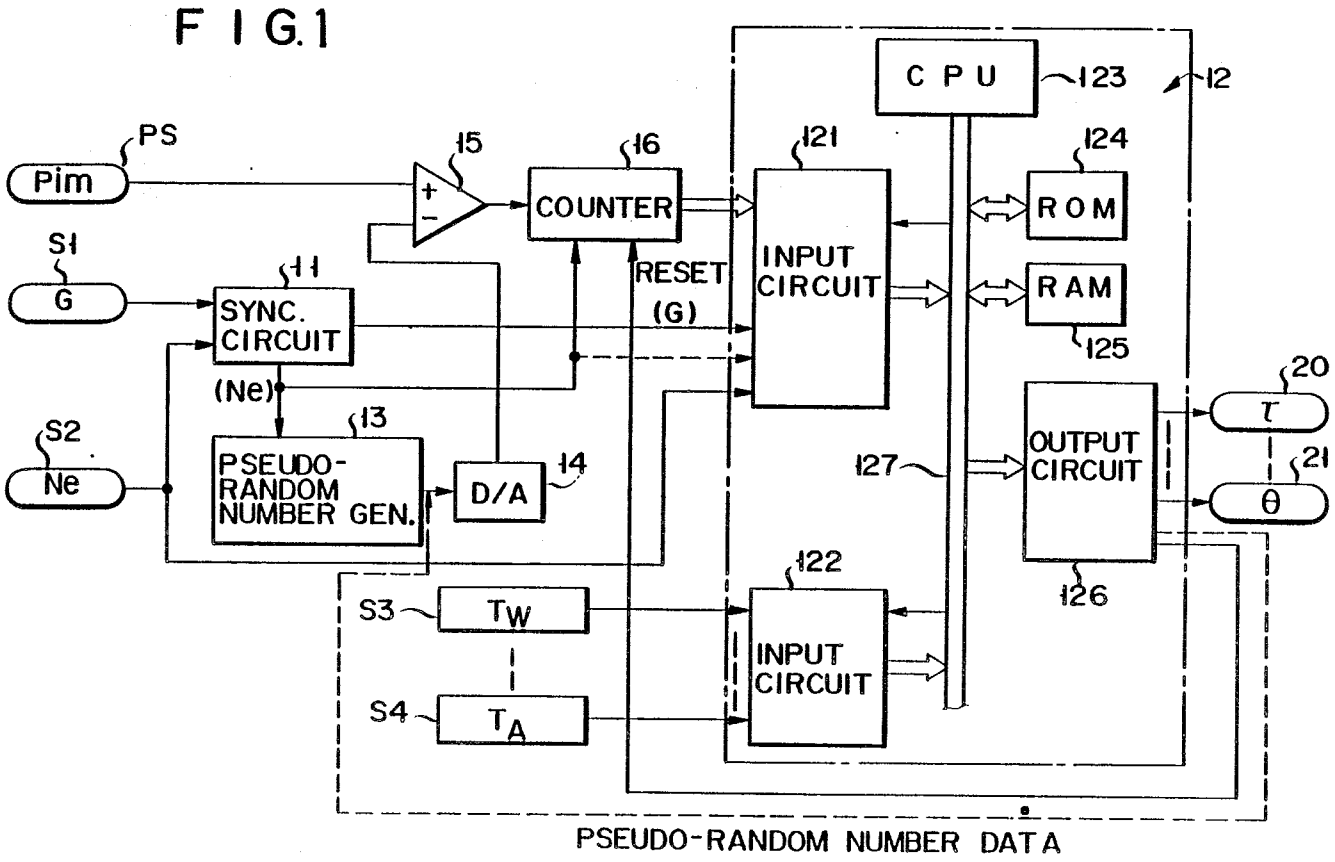
FIG. 1 is a circuit diagram of the apparatus according to a first embodiment of the invention for processing the detection signals from the device for detecting the operating state of the engine.

In the embodiment shown in FIG. 1, detection signal Pim from the pressure sensor provided in the air intake pipe of the engine is supplied to an engine control unit, which comprises a microcomputer and which calculates the amount of fuel to be injected and the ignition timing, etc. FIG. 1 shows an example of means for processing the input signal Pim. In order to perform this processing, the detection signals from the air pressure sensor PS in the air intake pipe together with the signals G and Ne from the first and second angle sensors S1 and S2 attached to the crankshaft are supplied to the control unit.

The first angle sensor S1 generates a crankshaft angle signal G for each 360° of crankshaft angle (CA). The second angle sensor S2 generates a detection signal for each 1° of crankshaft angle so that 360 signals are generated for each rotation, and the signal becomes a frequency signal comprising the rotation signal Ne. Signals G and Ne are supplied to synchronizing circuit 11, which synchronizes and outputs them. Crankshaft angle signal G is supplied to input circuit 121 of control unit 12 via synchronizing circuit 11 as an interrupt command.

Control unit 12 comprises input circuits 121 and 122, central processing unit (CPU) 123, ROM 124 for storing calculation program data, map data, etc., RAM 125 for storing various data used in the calculating process, and output circuit 126, etc. These circuit elements are interconnected by data bus 127.

Crankshaft angle signal Ne from synchronizing circuit 11 is supplied to pseudo random number generator 13 which outputs pseudo random data. Pseudo random number generator 13 generates a count signal synchronized with the input timing of signal Ne from synchronizing circuit 11 and generates a random count signal for each rotation signal Ne.

The pseudo random count data generated by pseudo random number generator 13 is converted to analog data by D/A converter 14 and is compared with detection data Pim from air intake sensor PS by comparator 15. Comparator 15 generates an output signal, when it is determined that detection data Pim is larger than the pseudo data, and supplies it to counter 16 as a count command.

Rotation signal Ne from synchronizing circuit 11 is supplied to counter 16, and the output signal from comparator 15 is discriminated in response to this signal Ne. When the signal from comparator 15 is high, counter 16 is incremented by one. The count data of counter 16 is supplied to input circuit 121 of control unit 12. The count data of counter 16 is supplied to control unit 12 as an intake air pressure signal by a command from CPU 123 when crankshaft angle signal G is input.

Pseudo random number generator 13 generates evenly distributed random number data. This random number data is generated uniformly at specified unit intervals of, in this case, 360° CA of crankshaft rotation, and the total number of random number data generation which is less than intake air pressure data Pim within this specified unit interval is determined by counter 16. Accordingly, the ratio of the total number of this random number data counted by counter 16 in relation to the total number of the random number data generated by pseudo random number generator 13 in the specified unit interval, in other words the generation ratio, is determined by the count value of counter 16. This ratio corresponds to the integral value of input data Pim, and from this value the average value of the intake air pressure in the unit period is determined. The coefficient used to determine this average value may be any constant providing a specified constant is applied to the count value of counter 16.

The various analog data from the sensors for detecting the operating state of the engine, such as temperature Tw from coolant temperature sensor S3 and temperature Ta from intake air temperature sensor S4, etc., are supplied to input circuit 122 of control unit 12 and are suitably converted to digital data. Based on a command from CPU 123 this digital data is supplied to CPU 123. Based on the engine operating data, such as the intake air pressure signal, control unit 12 calculates the fuel injection amount $\tau$ and the ignition timing $\theta$, and output signals corresponding to the calculation result are output from output circuit 126 to control fuel injection amount control unit 20 and ignition timing control unit 21, etc.

Output circuit 126 generates a reset signal corresponding to input crankshaft angle signal G and supplies it to counter 16. The count data of counter 16 is supplied to control unit 12 in correspondence with crankshaft angle signal G after which counter 16 is immediately reset.

Using the Hutchinson method, pseudo random number generator 13 generates random numerical data corresponding to each rotation angle signal Ne generated for every 1° of crankshaft angle. The equation for generating this random numerical data is $$Xi = aXi\text{-}1 (\text{mod } m)$$

Where m is the largest prime number that can be entered in one computer word for calculation by random number generator 13. In other words, the largest value in the range (1-m) that can be obtained as a random number is generated, and a is a primitive root of m, e.g., $a\sqrt{m}$. More specifically, when one word has 16 bits, $$Xi = 176Xi - 1 (\text{mod } 32749)$$

In other words, Xi is determined based on each rotation signal Ne, which is generated from synchronizing circuit 11 at each degree of crankshaft angle. Accordingly, based on the above equation, when a random number is to be generated, all the random numbers are generated in one round having a period of 32749 degrees CA. In this case, the 360 random numbers generated in the interval of 360° CA (one rotation of the crankshaft) are also assumed to be evenly distributed throughout the range of this interval.

The relationship between the frequency of the random number generation in one specified interval unit and the size of numerical value m is such that an increase in the random number generation frequency (in the embodiment it is 360) results in an increase in the amount of information, thereby increasing the resolution. Also, the larger the value m, the lower the degree of resemblance of the random number generation pattern in each unit interval, and the deviation of the averaged intake air pressure data determined for each unit is generated randomly so a more accurate measurement data can be obtained. Accordingly, even if it is necessary to generate 360 random numbers in one unit interval, it is desirable to increase the value of m.

Figure 2:
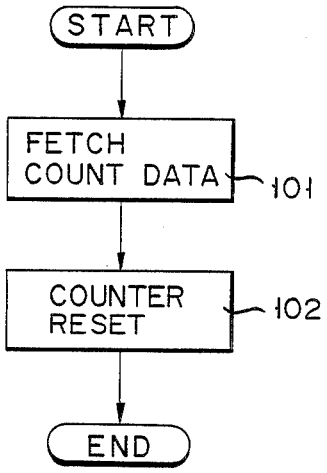
FIG. 2 is a flow chart showing the control of the counter used in the above embodiment.

An interrupt command is applied to engine control unit 12 based on crankshaft angle signal G. Corresponding to this interrupt signal, the count value of counter 16, as is shown in step 101 of FIG. 2, is supplied to engine control unit 12 as averaged digital data Pm of intake air pressure Pim. Then, in step 102 counter 16 is reset to the initial count value. This supplied value is the averaged value in the range of the time interval (the time interval of the signal generated every 360 degrees of crankshaft angle) in which crank angle signal G is generated and is sampled simultaneously with the rotation of the crankshaft.

Output circuit 126 of control unit 12 supplies commands corresponding to the calculation results by the control unit of the fuel injection quantity and the ignition timing, etc. at a specified timing to fuel injection unit 20 and ignition control unit 21.

Figure 3:
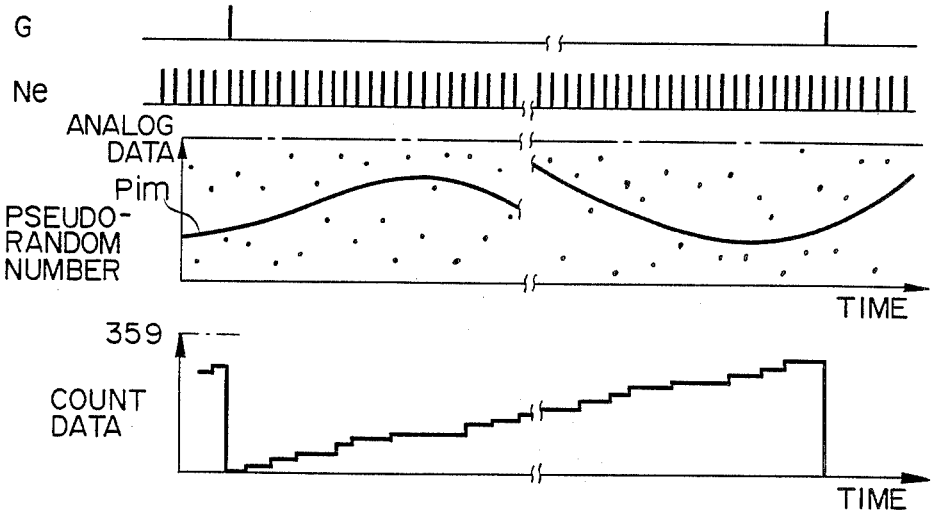
FIG. 3 shows the waveforms of the signals during operation of the embodiment.

FIG. 3 shows the waveforms of the signals in the control operation of the signal processing apparatus. Rotation signal Ne is generated in a period that is sufficiently smaller than that of the crankshaft angle signal G. Pseudo random number generator 13 outputs random numbers, as shown by the dots in the diagram, at a timing corresponding to these rotation angle signals Ne.

This random numerical data is supplied to comparator 15 together with intake air pressure detection data Pim. Comparator 15 generates output signals when the intake air pressure detection value Pim is larger than the random number data, counter 16 is accordingly incremented by this output signal, and counter 16 is reset when crankshaft angle signal G is generated, thereby returning to the original count data.

Input data Pm, which corresponds to the averaged intake air pressure supplied to control unit 12 in response to crank angle signal G, is stored in RAM 125 of control unit 12. This intake air pressure is operated on in accordance with a program stored in ROM 124 for calculating the engine control data for the amount of fuel to be injected and the ignition timing, etc.

Figure 4A:
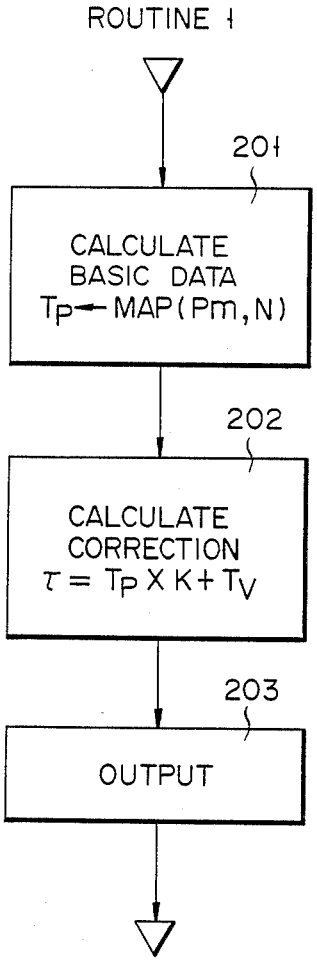
FIGS. 4A and 4B are flow charts showing the processing routine for calculating the fuel injection quantity and the ignition timing.

FIG. 4A shows routine 1 for calculating the fuel injection quantity. In step 201 the basic fuel injection quantity Tp is calculated based on intake air pressure data Pim and engine rotation number N from the two-dimensional map stored in ROM 124. In step 202 basic fuel injection quantity Tp is multiplied by constant K, correction value Tv is added, the fuel injection control quantity $\tau$ is calculated and, in step 203, the result is output.

Figure 4B:
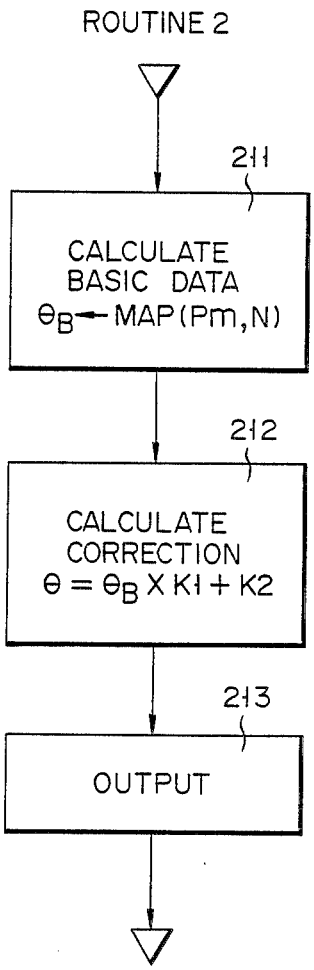

FIG. 4B shows routine 2 for calculating the ignition timing. In step 211 basic fuel injection timing $\theta$B is calculated based on intake air pressure Pm and rotation number N from the two-dimensional map stored in RAM 124. In step 212 a correction calculation is performed to determine ignition timing control quantity $\theta$ and, in step 213, the result is output.

With a signal processing apparatus constructed as described above, even if the output signal pulsates in response to the rotation of the engine, it is possible to output A/D converted data without using a pulsating signal processing circuit such as an integrating circuit. The signal is supplied to the engine control unit in digital form with the pulsating component eliminated and without a delay in time for use in calculating the fuel injection quantity and ignition timing, etc.

The generation of rotation signals Ne and crankshaft angle signals G, which control the signal processing operation, is such that if the generation period is further reduced to, for example, 0.5° and 90° CA, then even more accurate analog data will be obtained for digital conversion and supply to the control unit.

In the above embodiment, crankshaft angle signal G and rotation signal Ne were used for controlling the signal processing, however, these signals are not restricted to use in regards to the engine operation. A short interval first signal (corresponding to Ne) and a longer interval second signal (corresponding to G) may be produced by another signal generation means and used for pseudo random number generation.

Figure 5:
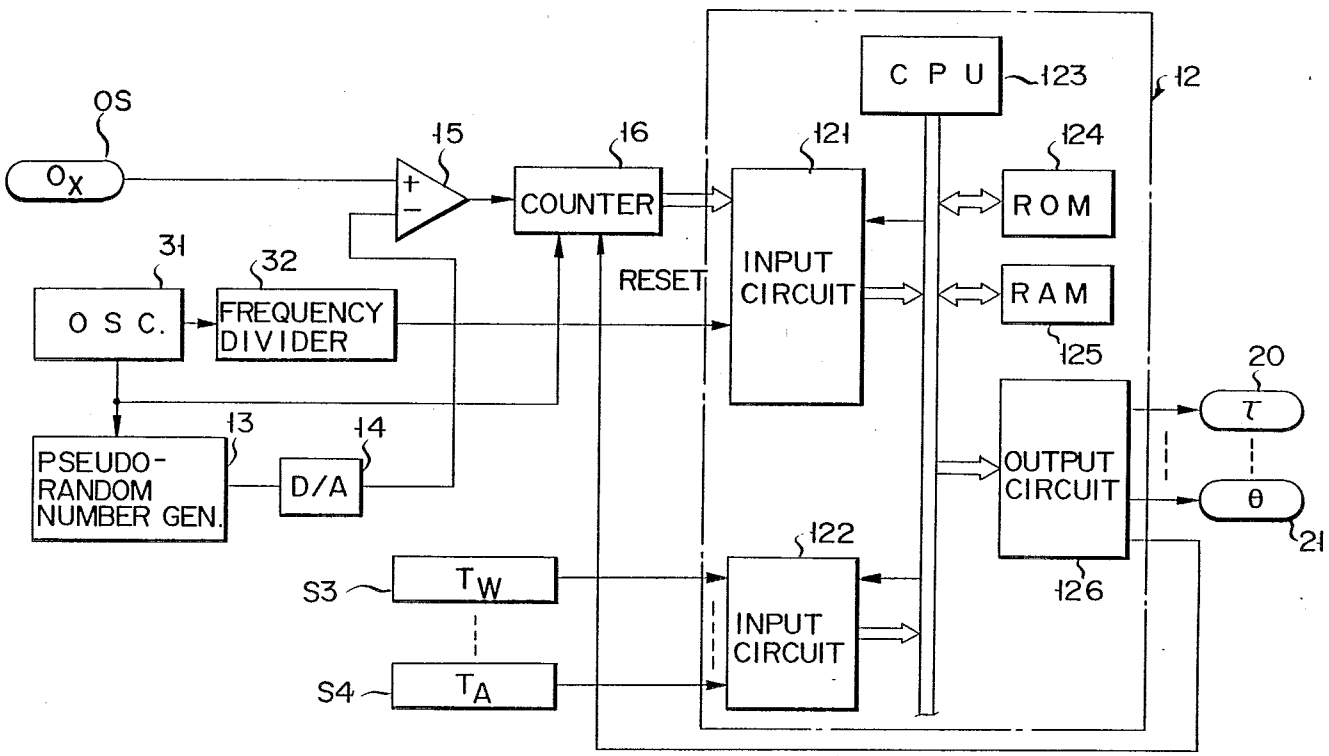
FIG. 5 is a circuit diagram of a second embodiment of the invention.

FIG. 5 shows such an embodiment in which oscillator circuit 31 generates a constant frequency signal fc which is supplied to pseudo random number generator 13 as the first signal and is supplied to dividing circuit 32 for division into a second signal having a frequency 1/fc.

In this embodiment the density of the oxygen included in the exhaust gas of the engine is detected Oxygen density sensor OS positioned in the exhaust pipe supplies detection signals Ox to comparator 15. The oscillation frequency fc of oscillator circuit 31 and the random number generation frequency of the pseudo random number generator 13 are determined based on the required accuracy of the oxygen density detection and on the period of variation in the density, etc. For example, if the required accuracy per unit of time is 8 bits, then 256 random numbers are generated per period. If this period is 1 second, for example, then the oscillation frequency will be 256 Hz, while if the required accuracy is 10 bits, the oscillation frequency will be 1024 Hz.

In other words, pseudo random number generator 13 generates pseudo random number data synchronously with the first signal from oscillator circuit 31. This pseudo random number data is converted to analog data by D/A converter 14 and compared with oxygen detection signal Ox. The output of comparator 15 is detected by counter 16 based on the first signal from oscillator circuit 31. The count value of counter 16 is supplied to control unit 12 in response to the second signal from dividing circuit 32.

In the above embodiment the oxygen density Ox in the exhaust gas was measured. When, however, the intake air pressure Pim is measured, for example, the pressure variation period is synchronous with the engine rotation period, which is brief, so that the oscillation frequency fc of oscillation generator 31 must be large; i.e., 100 kHz. This apparatus may be used with other detection values such as the intake air volume or the engine coolant temperature, for example.

In the above description, pseudo random number generator 13 was provided as a special external circuit. It is, however, possible to generate pseudo random numbers by applying an interrupt command to control unit 12 (as shown by the broken line in FIG. 1) based on rotation signal Ne, which is generated for every angle of crankshaft rotation, and running a random number generating routine based on a program stored in control unit 12.

What is claimed:

1. An apparatus for processing signals from a device for detecting the operating state of an engine, comprising:

first signal generating means for generating a first signal in a first period in response to detection parameters of said device of a desired detection accuracy:

second signal generating means for generating a second signal in a second period which is longer than said first period;

pseudo random number generating means for generating random numbers in response to said first signal;

comparing means for comparing a detection signal level from said device for detecting the operating state of the engine and random number data generated by said pseudo random number generating means and providing an output signal;

counting means which is incremented by the output signal from said comparing means in response to said first signal; and control means for outputting count data of said counting means based on said second signal and then resetting said counting means to an initial value.

2. An apparatus according to claim 1, wherein said first signal generating means comprises an oscillator circuit and said second signal generating means comprises a dividing circuit which divides output signals from said oscillator circuit.

3. An apparatus according to claim 1, wherein said control means comprises a control unit which electronically controls the engine.

4. An apparatus according to claim 1, wherein said means for detecting the operating state of the engine comprises a sensor for detecting a pulsating state corresponding to the rotation of the engine and the pulsating detection signal from this sensor is supplied to said comparing means.

5. An apparatus according to claim 1, further comprising digital to analog converting means which converts digital random data generated by said pseudo random number generating means to analog data which is compared with the analog detection signal level of said detection signal by said comparing means.

6. An apparatus according to claim 1, wherein said means for detecting the operating state of the engine comprises a detection element which detects changes in the pulsating analog state corresponding to the rotation of the engine, the pulsating signal from said detection element being supplied to said comparing means, and the random number data from said pseudo random number generator being converted to analog data and supplied to said comparing means, which compares the analog pseudo random number data and the analog detection signal.

7. An apparatus according to claim 6, wherein said means for detecting the operating state of the engine comprises intake air measurement detection means provided in an intake air pipe of the engine.

8. An apparatus according to claim 1, wherein said pseudo random number generating means generates random numbers by the Hutchinson method and calculates random number data in response to each of said first signals according to a random number generating equation in which $Xi=aXi\text{-}1(\text{mod } m)$, said comparing means comparing this random number data and the engine operating state detection signal.

9. An apparatus according to claim 8, wherein m of said pseudo random number generating equation is the largest prime number that can be expressed by one computer word and a is $\sqrt{m}$.

10. An apparatus according to claim 1, wherein said first and second signals are a rotation signal Ne generated at every specified angle of rotation of the engine and an engine crankshaft angle signal G, respectively.

11. An apparatus according to claim 10, wherein said rotation signal Ne is generated at every 1° of crankshaft rotation and said crankshaft angle signal is generated every 360° of crankshaft rotation.

12. An apparatus according to claim 2, wherein said rotation signal Ne is generated at every 0.5° of crankshaft rotation and said crankshaft angle signal is generated every 90° of crankshaft rotation.

* * * * *